US005102450A

United States Patent [19]

Huang

[11] Patent Number: 5,102,450

[45] Date of Patent: Apr. 7, 1992

[54] METHOD FOR MELTING TITANIUM ALUMINIDE ALLOYS IN CERAMIC CRUCIBLE

[75] Inventor: Shyh-Chin Huang, Latham, N.Y.

[73] Assignee: General Electric Company, Schenectady, N.Y.

[21] Appl. No.: 739,004

[22] Filed: Aug. 1, 1991

[51] Int. Cl.[5] ..... C22C 14/00; C21D 1/00

[52] U.S. Cl. ..... 75/10.65

[58] Field of Search ..... 420/590, 417; 75/10.65

[56] References Cited

U.S. PATENT DOCUMENTS

| | | | |
|---|---|---|---|
| 4,710,481 | 12/1987 | Degawa et al. | 501/123 |
| 5,028,491 | 7/1991 | Huang | 420/417 |
| 5,045,406 | 9/1991 | Huang | 420/417 |

OTHER PUBLICATIONS

"Melting and Precision Casting of Pure Titanium Using Calcia", Sixth World Conference on Titanium, France, 1988, pp. 707–713.

*Primary Examiner*—Peter D. Rosenberg

*Attorney, Agent, or Firm*—James E. McGinness; James C. Davis, Jr.; James Magee, Jr.

[57] ABSTRACT

Gamma titanium aluminide alloys can be melted by a method comprising, melting a charge comprised of the titanium aluminide alloy and an effective amount of a metal from the group consisting of niobium, tantalum, tungsten, and molybdenum to reduce oxygen pickup in the melt, the melting being performed in a calcia crucible.

6 Claims, No Drawings

METHOD FOR MELTING TITANIUM ALUMINIDE ALLOYS IN CERAMIC CRUCIBLE

BACKGROUND OF THE INVENTION

This invention is concerned with a method of melting titanium aluminide alloys in ceramic crucibles.

The melting of small quantities of titanium was first experimented with in 1948 using methods such as resistance heating, induction heating, and tungsten arc melting. However, these methods never developed into industrial processes. The development during the early 1950s of the cold crucible, consumable-electrode vacuum arc melting process, known as "skull melting," by the U.S. Bureau of Mines made it possible to melt large quantities of titanium with minimal contamination into ingots or net shapes.

Titanium aluminide alloys are made by arc melting under protective conditions, for example, in an inert atmosphere such as argon, in a water cooled copper crucible by the skull melting process. Briefly described, vacuum arc skull melting furnaces consist of a vacuum-tight chamber in which a titanium or titanium alloy electrode is driven down into a water-cooled copper crucible. A dc powder supply provides the fusing current needed to strike an electric arc between the consumable electrode and the crucible. Because the crucible is water cooled, a solidified skull of the titanium or titanium alloy melt forms at the crucible surface, thus avoiding direct contact between melt and crucible. Once the predetermined amount of liquid titanium is contained in the crucible, the electrode is retracted, and the crucible is tilted to pour the melt into a casting mold positioned below. Special containers such as water cooled copper crucibles are required to melt refractory metals because of the strong reactivity of refractory metals, such as titanium, with ceramic crucibles.

Although the skull melting process is a proven and capable method for melting titanium and titanium alloys, it is energy intensive and affords little opportunity for superheating the molten metal because of the cooling effect of the water-cooled crucible. Because of the limited superheating, it is common to either pour castings centrifugally, forcing the metal into a mold cavity, or to pour statically into preheated molds to obtain adequate fluidity. It is highly desirable to develop methods for melting titanium alloys in ceramic crucibles to reduce the energy required for melting, and allow for obtaining higher levels of superheating. However, the ceramic crucible melting must provide a level of oxygen pickup in the melt that is comparable to the oxygen pickup achieved in the skull melting process.

The titanium alloys of interest for melting in the method of this invention are the gamma titanium aluminides. Gamma titanium aluminides are well known being characterized by a tetragonal crystal structure, and are comprised of about 48 to 58 atom percent aluminum. Gamma titanium aluminide alloys comprised of a minor amount of alpha-2 phase are comprised of as low as 40 atom percent aluminum. Additional elements, for example, chromium, vanadium, niobium, tantalum, silicon, and gallium have been added to gamma titanium aluminide alloys as shown for example in U.S. Pat. Nos. 3,203,794; 4,294,615; 4,661,316; 4,857,268; 4,842,820; 4,842,817; 4,836,983; 4,879,092; 4,902,474; 4,897,127; 4,923,534; 4,916,028; incorporated herein by reference. The low ductility of the gamma titanium aluminides at room temperature has been the major limitation to forming components of the alloys. It is well known that oxygen is an interstitial contaminant in gamma titanium aluminides that contributes to the room temperature brittleness of the alloy.

It is an object of this invention to provide a method for melting gamma titanium aluminide alloys in a ceramic crucible, while minimizing oxygen pickup in the melt.

BRIEF DESCRIPTION OF THE INVENTION

The method of this invention provides for melting gamma titanium aluminide alloys in ceramic crucibles. A charge is melted comprised of the gamma titanium aluminide alloy and an effective amount of a metal from the group consisting of niobium, tantalum, tungsten, and molybdenum to reduce oxygen pickup in the melt, the charge being melted in a calcia crucible. Preferably, the metal is niobium at about 2 to 12 atom percent, and most preferably about 4 to 8 atom percent. We have discovered that the niobium addition reduces oxygen pickup from the calcia crucible during melting of the charge. It is well known that the toughness and ductility of gamma titanium aluminides is adversely reduced by oxygen pickup in the melt.

DETAILED DESCRIPTION OF THE INVENTION

The method of this invention can be used for melting gamma titanium aluminide alloys. A charge of the gamma titanium aluminide alloy is formed in a calcia crucible. The charge can be formed from the desired weight percent of each element, or alloys of the elements. The charge can be deposited in the crucible as a solid, a mixture of solids, a molten metal, or mixtures thereof. Preferably, the charge is formed from high-purity materials to minimize the introduction of contaminants such as oxygen, nitrogen, hydrogen, and carbon. Preferably, the charge is formed so that contact between titanium and the crucible is minimized. For example, the aluminum, chromium, and niobium are first melted in the crucible, and titanium is added to the melt. Alternatively, the charge is formed so that aluminum, chromium, and niobium solids are adjacent the crucible, and titanium solids are on top of the aluminum, chromium, and niobium, separated from the crucible. In this way, the titanium is melted last and the molten titanium is exposed for the minimum time to the ceramic crucible.

Heat is applied by a conventional method such as, for example, high-frequency, or low-frequency induction, plasma, arc, or resistance heating to melt the charge in the crucible.

The charge is melted in a conventional calcia crucible. A suitable calcia crucible is comprised of calcia and may contain other ceramics that do not react with molten titanium or titanium alloys. For example, a suitable calcia crucible is comprised of calcia and calcium floride, available from Calceed Co., Ltd., Japan. Preferably, the calcia crucible is formed from a high-purity calcia, for example, described in U.S. Pat. No. 4,710,481, incorporated herein by reference. Briefly described, the calcia crucible is a container having at least the inner side thereof formed of calcia. In other words, the crucible may be formed solely of calcia, or a shell of a refractory having a high melting temperature is formed to have an inner liner of the calcia.

Titanium aluminide alloy melts formed by the method of this invention can be formed into components by conventional methods such as casting, crystal-pulling, or sprayed to form powders. For example, a bottom pouring nozzle is formed in the calcia crucible, and a plug of the alloy is placed in the nozzle. The melt is formed in the crucible and melts the plug so that a molten stream pours from the nozzle and gas jets atomize the stream to form a powder.

Additional features and advantages of the method of this invention are shown by the following examples.

EXAMPLE 1

The first example was performed to show the level of oxygen pickup in a melt of gamma titanium aluminide alloys obtained by conventional melting. Several charges of gamma titanium aluminide alloys were formed from high-purity titanium sponge about 99.9 percent pure, high-purity aluminum about 99.99 percent pure, and high-purity chromium and niobium about 99.9 percent pure. The charges were placed in a water cooled copper crucible arc melting furnace obtained from Retech, Inc., Ca. The charges were melted under a protective atmosphere of argon by arc melting using the skull melting method. After the charge was melted the arc was extinguished and the charge was allowed to solidify in the copper crucible. The solidified melt was turned over in the crucible and remelted by the same arc skull melting method to cause further mixing of the melt. The melting was repeated so that the charge was melted a total of three times to form the final casting. The casting was removed from the copper crucible and the oxygen concentration of each casting was analyzed by infrared radiation. The weight, composition, and heating time, of each charge along with the final oxygen content of each casting are shown below in Table 1.

TABLE 1

Titanium Aluminide Alloys Melted By Arc Skull Melting

| Melt No. | Charge Weight (Grams) | Composition (Atomic Percent) Ti | Al | Cr | Nb | Heating Time (Minutes) | Oxygen Concentration (Parts Per Million) |
|---|---|---|---|---|---|---|---|
| 1. | 280 | Bal. | 48 | | | 10 to 15 | 422 |
| 2. | 280 | Bal. | 48 | | | 10 to 15 | 517 |
| 3. | 280 | Bal. | 45 | 2 | 2 | 10 to 15 | 945 |
| 4. | 280 | Bal. | 47 | 2 | 8 | 10 to 15 | 560 |
| 5. | 280 | Bal. | 46 | 2 | 12 | 10 to 15 | 880 |

EXAMPLE 2

Calcia crucibles comprised of 99 percent purity fused calcia were obtained from Mitsui Zosen Incorporated (USA), New York. Two gamma titanium aluminide alloys were melted by induction heating in the calcia crucibles. Three to four charges were melted in each crucible with a slight variation in the charging procedure for each melt. The charges were formed from high-purity titanium sponge about 99.9 percent pure, high-purity aluminum about 99.99 percent pure, and high-purity chromium and niobium about 99.9 percent pure. The charges were formed by placing pieces of the elements in the crucible in the following order:

Melt 1; chromium, niobium, aluminum, titanium,
Melt 2; titanium, aluminum, niobium, chromium,
Melt 3; titanium, aluminum, niobium, chromium,
Melt 4; niobium, chromium, aluminum, titanium,
Melt 5; all four elements melted together, and
Melts 6 and 7; niobium and aluminum melted first followed by chromium and titanium.

Each melt was poured into a graphite or copper mold and the oxygen concentration of each cast melt was analyzed by infrared radiation. The weight, composition, and heating time, of each charge along with the final oxygen content of each casting are shown below in Table 2.

TABLE 2

Titanium Aluminide Alloys Melted in Calcia Crucible

| Charge No. | Charge Weight (Grams) | Composition (Atomic Percent) Ti | Al | Cr | Nb | Heating Time (Minutes) | Oxygen Concentration (Parts Per Million) |
|---|---|---|---|---|---|---|---|
| 1. | 300 | Bal. | 48 | 2 | 8 | 21 | 1420 |
| 2. | 300 | Bal. | 48 | 2 | 8 | 36 | 1700 |
| 3. | 300 | Bal. | 48 | 2 | 4 | 38 | 2510 |
| 4. | 300 | Bal. | 48 | 2 | 4 | 21 | 2180 |
| 5. | 200 | Bal. | 48 | 2 | 4 | 47 | 2220 |
| 6. | 300 | Bal. | 48 | 2 | 4 | 20 | 2000 |
| 7. | 200 | Bal. | 48 | 2 | 8 | 21 | 960 |

In Table 2, charge numbers 1-4 were melted in one crucible, and charge numbers 5-7 were melted in another crucible.

In Table 1 it is shown that conventional skull melting produces a gamma titanium aluminide alloy having an oxygen content from about 422 to 945 parts per million. From Table 2 it can be seen that an appreciable oxygen pickup occurs when a gamma titanium aluminide alloy is melted in the ceramic calcia crucible. However, oxygen pickup is reduced as niobium content is increased. For example, the gamma titanium aluminide alloys having a niobium content of 8 atom percent have greatly reduced oxygen pickup that is about half the oxygen pickup in alloys comprised of 4 atom percent niobium. In addition, the oxygen pickup for alloys comprised of 8 atom percent niobium is comparable to the oxygen pickup found in skull melting.

What is claimed is:

1. A method of melting a gamma titanium aluminide alloy comprising, melting a charge comprised of the titanium aluminide alloy and an effective amount of a metal from the group consisting of niobium, tantalum, tungsten, and molybdenum to reduce oxygen pickup in the melt, the melting being performed in a calcia crucible.

2. The method of claim 1 wherein the metal is niobium.

3. The method of claim 2 wherein an effective amount is about 2 to 12 atom percent.

4. The method of claim 2 wherein an effective amount is about 4 to 8 atom percent.

5. The method of claim 1 wherein the charge is formed so that titanium in the charge has minimized contact with the crucible.

6. The method of claim 3 wherein the charge is formed so that titanium in the charge has minimized contact with the crucible.

* * * * *